United States Patent [19]

Szarka

[11] 4,364,430

[45] Dec. 21, 1982

[54] ANCHOR POSITIONER ASSEMBLY

[75] Inventor: David D. Szarka, Duncan, Okla.

[73] Assignee: Halliburton Company, Duncan, Okla.

[21] Appl. No.: 209,620

[22] Filed: Nov. 24, 1980

[51] Int. Cl.[3] ..... E21B 23/02

[52] U.S. Cl. ..... 166/214; 166/217; 166/240; 166/381

[58] Field of Search ..... 166/136, 214, 240, 217, 166/381

[56] References Cited

U.S. PATENT DOCUMENTS

| | | | |
|---|---|---|---|
| 2,431,751 | 12/1947 | Hayward | 166/217 |
| 2,673,614 | 3/1954 | Miller | 166/217 |
| 2,988,177 | 6/1961 | Conrad | 188/83 |
| 3,057,407 | 10/1962 | Grimmen | 166/125 |
| 3,209,832 | 10/1965 | Tausch | 166/240 |
| 3,455,381 | 7/1969 | Page, Jr. | 166/121 |
| 3,507,329 | 4/1970 | Sxone, Jr. | 166/214 |
| 3,519,074 | 7/1970 | Berryman | 166/123 |
| 3,603,392 | 9/1971 | McGill | 166/216 |
| 3,746,093 | 7/1973 | Mullins | 166/217 |
| 3,783,941 | 1/1974 | Kisling | 166/217 |
| 3,856,081 | 12/1974 | Canalizo | 166/136 |
| 3,937,279 | 2/1976 | Raulins | 166/214 |
| 4,059,150 | 11/1977 | Manderschied | 166/120 |
| 4,105,069 | 8/1978 | Baker | 166/51 |
| 4,139,059 | 2/1979 | Carmichael | 166/208 |

*Primary Examiner*—Stephen J. Novosad
*Attorney, Agent, or Firm*—Joseph A. Walkowski; Thomas R. Weaver

[57] ABSTRACT

An improved anchor positioner for use with anchors incorporated in a liner or casing of a well bore. The anchor positioner comprises upward-facing spring arms having downward facing shoulders on the exterior thereof, the spring arms, when extended radially outward, engaging a shoulder on an anchor to locate a tool string in a well bore. An indexing head, rotatable in response to axial reciprocation of the tool string, retracts the spring arms from the anchor. A subsequent reciprocation of the tool string will cause the spring arms to extend radially outward and to be locked in the extended position by contact with the indexing head, thus locking them into the anchor against downward movement. Retraction of the spring arms is effected by force from contact with inwardly-inclined faces on the indexing head, and extension of the spring arms is effected by outward force exerted by contact of the inside of the spring arms with axial grooves on the outside of the indexing head. Rotation of the indexing head and therefore change of radial alignment is effected through a pin and slot mechanism.

22 Claims, 9 Drawing Figures

ANCHOR POSITIONER ASSEMBLY

SUMMARY OF THE INVENTION

When drilling, treating and producing petroleum and natural gas wells, it often is desirable and sometimes necessary to locate and anchor various tools or other devices suspended from a string of pipe at a particular level in the well bore. Such an operation is necessary in oil wells, for example and not by way of limitation, when gravel packing a producing formation, when chemically treating a formation, when cementing a well, when inflating a packer or when testing a well. A number of different devices designed to accomplish this operation have been employed in the prior art, utilizing different approaches.

U.S. Pat. No. 2,673,614 discloses an apparatus for anchoring tools within a well, which apparatus employs keys to locate the anchor at the appropriate levels in the well, and locking dogs to hold it. However, the grooves in the well casing which the keys engage at various levels are all different, the anchor may engage at only one level per trip in the well, and the anchor may be retrieved only by pulling the pipe string, attaching a fishing tool, and going back in the well to engage the anchor. U.S. Pat. Nos. 3,057,407 and 3,507,329 disclose similar devices which are somewhat improved in operation, but which still possess the same enumerated disadvantages.

U.S. Pat. Nos. 3,455,381, 3,519,074, 3,603,392, 3,783,941 and 4,059,150 disclose setting or anchoring tools employing the use of mechanically or hydraulically operated slips to position and anchor the tool string in the well. The employment of slips, however, does not permit precise positioning, and, moreover, may lead to the tool string becoming stuck in the well if the slips fail to release.

U.S. Pat. Nos. 3,937,279 and 4,139,059 disclose devices which employ collet fingers to hang the tool string at a particular level when the fingers engage a shoulder in the well casing. While providing a positive means of location in the well, neither possesses a means to lock the positioning fingers in a retracted position so as to pass by a shoulder in the casing, or to visit more than one level per trip into the well.

U.S. Pat. No. 4,105,069 discloses a retraction mechanism similar to that of the present invention, but for use in operating a cementing or gravel collar. Positioning the tool string disclosed therein is accomplished by logging the positions of the collars, and hanging the tool string on collar sleeves at the various levels with permanently released spring arms necessitating a balancing of weight on the tool string to ensure the collar is not reclosed. No separate anchor tool is employed, so the collars cannot remain open as the tool string passes downward, and the spring fingers must be forced through the collars at each level.

U.S. patent application Ser. No. 107,753, entitled "Anchor and Anchor Positioner Assembly" by David D. Szarka and Eugene E. Baker, assigned to the assignee of the present application and incorporated herein by reference, discloses a more satisfactory locating and anchoring mechanism for a tool string. Briefly, the application discloses a method and apparatus for locating a tool string at a specific level in a well bore, anchoring the string at that level and proceeding from that level to another in the well bore, either higher or lower, in the same trip. The device comprises a two-part anchoring apparatus, comprising an anchor tool incorporated in a liner or casing, and a cooperating inner anchor positioner which is attached to a tool string. The anchor tool possesses substantially the same inner bore as that of the casing above and below it, with an annular upward-facing shoulder upon its inner wall, there being areas of enlarged diameter both above and below the shoulder. The anchor positioner comprises upward-projecting spring arms having at their extremities radially outward projecting, downward-facing shoulders. When these shoulders engage the annular shoulder of an anchor tool, the anchor positioner holds the tool string in position. In order to release the anchor positioner, a drag block assembly which can be made to engage and compress the spring arms is slidably mounted above the spring arms, thereby releasing them from the anchor tool, by either reciprocating or rotary and reciprocating motion of the tool string, as illustrated in another embodiment of the invention. Yet another embodiment of the invention is also disclosed which employs both rotary and reciprocating motion to engage and disengage the anchor positioner from the anchor tool, and utilizes splines on the anchor positioner which cooperate with grooves on the anchor tool to hold the anchor positioner in place. All of these embodiments possess the capability of visiting multiple locations with a tool string in one trip in the well, holding the tool string at each location, and subsequently releasing and repositioning the tool string at another level higher or lower than the first. The anchors for an individial embodiment are the same at each level, and no additional mechanisms other than the anchor and anchor positioner are necessary for operation of the device.

While the embodiments of the device disclosed in Ser. No. 107,753 perform in an acceptable manner in many instances, reliability in well bores which deviate from the vertical poses a major problem. Because the spring arms which engage the anchor shoulder are held in place only by their own resiliency and the weight of the string, there is a tendency for the anchor positioner to release if it is not centered in the casing, as the spring fingers on one side may be out of contact with the anchor shoulder and the others may be retracted from the anchor by the lateral force of the string weight in a deviated hole.

Generally, the prior art suffers from a number of deficiencies, and the employment of a particular type of mechanism to overcome one problem often results in the insolubility of another. The first difficulty encountered is an inability to locate the exact position desired in the well bore, which is inherent to the use of slips. When that problem is solved through the use of keys or collet fingers, the prior art encounters the inability to visit more than one level per trip in the well. Indeed, many prior art tools require two trips per location, one to set the anchor and another to retrieve it. If an operator employs some prior art tools which can visit multiple locations, even with multiple trips, he is faced with the problem of putting various nipples or landing shoulders of different sizes and configurations in the liner or casing string, which necessarily complicates both the installation and inventory of parts which must be utilized. Some devices which permit the visitation of multiple levels per trip are dependent on the application of a relatively large force to release, and may interfere with the operation of other tools in the liner. Finally, a prior art device which possesses the ability to visit exactly the levels desired and multiple levels per trip lacks a positive, non-spring dependent anchoring feature.

In contrast, the present invention overcomes all of the previously enumerated disadvantages and limitations of the prior art by providing a new and advantageous method and apparatus for locating a tool string at a specific level in a well bore, positively anchoring the string at that level and proceeding from that level to another in the well bore, either higher or lower, in the same trip. The present invention contemplates a positive release and retract anchor positioner attached to a tool string, which cooperates with an anchor tool or a plurality of substantially identical anchor tools of the type previously disclosed in Application Ser. No. 107,753. This anchor tool, as noted previously, possesses substantially the same inner bore as that of the casing or liner above and below it, with an annular upward-facing shoulder upon its inner wall, there being areas of enlarged diameter both above and below the shoulder on the inside of the tool. The anchor positioner of the present invention comprises upward-projecting spring arms having radially outward projecting, downward-facing shoulders at their extremities. The spring arms are naturally biased outwardly, toward a released position, which position would engage the shoulder of the previously described anchor tool. However, unlike the prior art anchor positioner of application Ser. No. 107,753, the spring arms of the present invention are positively biased outwardly to a release position by a portion of a slidable indexing head assembly oriented in a first position immediately above the spring arms. When it is desired to release the spring arms from the anchor tool, the tool string is reciprocated, which reciprocates the indexing head assembly and rotates it through a predetermined arc, the indexing head assembly then engaging and compressing the spring arms in its second, rotated position, thus releasing them from the anchor tool. Further reciprocation of the tool string will again reciprocate and rotate the indexing head assembly, locking the spring arms in a released position. The anchor positioner of the present invention thus possesses the capability of visiting multiple locations with a tool string in one trip in the well, positively locking the tool string at a location, and subsequently positively retracting the spring arms, releasing the tool string and repositioning it at another level higher or lower than the first. No movement other than reciprocation of the tool string is necessary for changing the anchor positioner from the release to the retract mode, and locking the tool in each mode.

It is thus apparent that the apparatus and method of the present invention possesses many new advantages hitherto unknown in the prior art, without any disadvantages being associated therewith.

BRIEF DESCRIPTION OF THE DRAWINGS

The invention will be more fully understood from the following detailed description, taken in conjunction with the accompanying drawings, in which.

DESCRIPTION OF THE PREFERRED EMBODIMENT

Figure 1A:
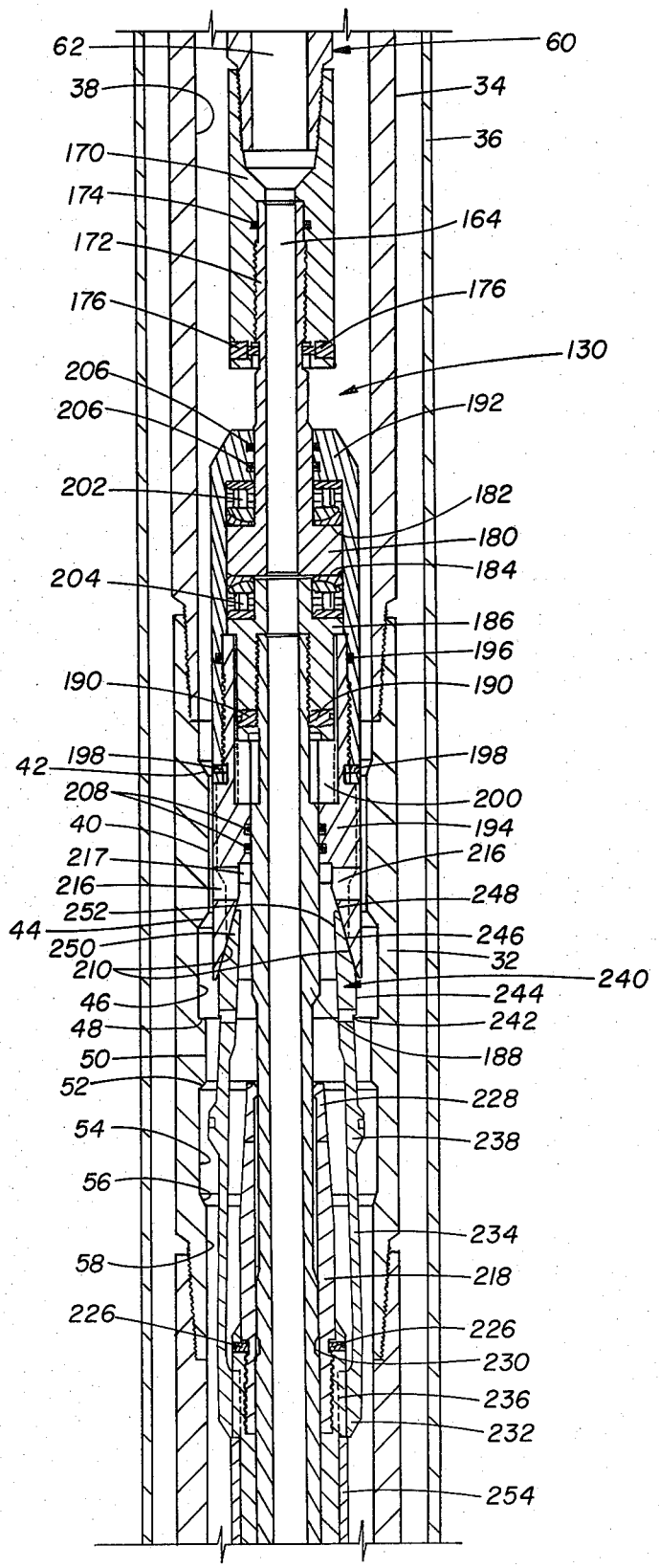
FIGS. 1A and 1B provide a vertical cross-sectional elevation of the anchor positioner of the present invention in its locked retract mode, adjacent an anchor tool in a casing string.

Referring now to the drawings, and to FIGS. 2A, 2B, 2C, 4, 5 and 6 in particular, the anchor positioner of the present invention are illustrated in detail. Anchor positioner 130 is disposed within a liner 34 at a location where anchor tool 32 is positioned. Liner 34 may in turn be disposed within casing 36, in a well bore (not shown). Alternatively, liner 34 may be run in an open well bore. Moving downwardly from the top of the liner as shown, bore 38 of liner 34 continues to anchor tool 32, where uniform inward-facing annular surface 40, defined by an upper beveled surface 42 as well as a lower, extended beveled surface 44 leading to annular recess 46 is located. At the lowest extremity of recess 46 is located inwardly extending upward-facing annular shoulder 48, below which is axial surface 50, and outwardly beveled surface 52, followed by a second annular recess 54. Both surfaces 46 and 54 possess a bore larger than that of liner 34. Below recess 54 inwardly beveled surface 56 leads to lower bore 58, of substantially the same diameter as liner bore 38. It should be noted that an anchor tool 32 has been located in the well bore so that a tool string 60 to which is attached anchor positioner 130 will be properly positioned to effect treatment of a well such as acidizing, cementing or gravel packing via other tools on tool string 60 in cooperation with tools in liner 34. For example, the operator may want to position an isolation gravel packer across a gravel collar. Similarly, a cementing collar may be located. In addition, it is understood that the anchor positioner of the present invention is not limited to employment with an anchor tool incorporated in a liner, but may be utilized with an anchor tool which is part of a casing in an unlined hole in the same manner as illustrated herein with respect to a liner.

Referring again to FIGS. 2A, 2B and 2C of the drawings, anchor positioner 130 is lowered into liner 34 with tool string 60. If desired, tool string 60 may have bore 62 therethrough, cooperating with bores 164, 166 and 168 whereby fluids may be transmitted up or down the interior of the tool string. Anchor positioner 130 is threadably attached to tool string 60 by adapter 170, which is in turn threadably attached to upper mandrel 172 and a fluid seal provided therebetween by O-ring 174 disposed in an annular recess in adapter 170. Adapter 170 is fixedly secured to upper mandrel 172 with locking pins 176.

The lower extent of upper mandrel 172 comprises radially-extending thrust shoulder 180, having upper and lower annular surfaces 182 and 184, respectively. Lower surface 184 of upper mandrel 172 is axially adjacent to mandrel adapter 186, which is threaded to J-slot mandrel 188, and locked thereto by set screws 190. Enveloping the lower end of upper mandrel 172 and the junction of mandrel adapter 186 and J-slot mandrel 188 is the indexing head assembly, comprising indexing head extension 192 and indexing head 194. Indexing head extension 192 and indexing head 194 are threaded to each other, with O-ring 196 therebetween, set screws 198 locking the two components together. Indexing heads 194 (and therefore the entire indexing head assembly) is splined to J-slot mandrel 188 with splined bushing 200. Roller thrust bearings 202 and 204 are locked within the indexing assembly, upper bearing 202 abutting upper annular surface 182 on upper mandrel 172, and lower bearing 204 abutting lower annular surface 184 on upper mandrel 172. The purpose and operation of thrust bearings 202 and 204 will be described hereafter in conjunction with the operation of the preferred embodiment. O-rings 206 seal between indexing head extension 192 and upper mandrel 172, and O-rings 208 seal between J-slot mandrel 188 and indexing head 194. The lower end of indexing head 194 comprises a plurality of radially-spaced downwardly, outwardly inclined surfaces 210, between which are interposed a plurality of radially-spaced axially oriented grooves 212 on the outer surface of indexing head 194 (see FIG. 4). Grooves 212 have inclined lower leading ends 214 which extend to the lower end of indexing head 194. Apertures 216 in inclined surfaces 210 promote fluid flow in the liner as tool string 60 is raised or lowered, and annulus 217 permits communication between apertures 216.

Below the indexing head assembly, collet body 218 is slidably mounted on J-slot mandrel 188, and is threaded to mandrel body 220, having J-slot pins 222 which engage continuous J-slots 224 in J-slot mandrel 188. Collet body 218 is locked to mandrel body 220 with set screws 226. The upper extent of collet body 218 comprises collet fingers 228, which are shown engaging annular recess 230 in the exterior of J-slot mandrel 188. Spring positioner body 232 having a plurality of upwardly facing spring arms 234 thereon is splined to mandrel body 220 as shown at 236. Each of spring arms 234 possesses an intermediate radiallyoutward extending shoulder 238, with beveled leading and trailing edges, and a carbide button embedded therein. At the upper extent of each spring arm 234 is a protrusion 240 having a lower, radially flat face 242, an outer, axially flat face 244, and a gradually radially inwardly inclined face 246 leading to a pointed tip 248. The lateral surfaces 250 of protrusions 240 incline outwardly from a narrow, axially flat inner surface 252 (see FIG. 5). It should be noted that the tips 248 of spring arms 234 are disposed on a lesser radius than that of the radially outermost extent of inclined surfaces 210 on indexing head 194. Positioner body 232 is maintained in position on mandrel body 220 by spacer body 254, which is abutted by drag block body 256, threaded to the lower end of mandrel body 220. Drag block body 256 is locked to mandrel body 220 by locking pins 258, a seal being achieved between the two components by O-ring 260.

The lower end of J-slot mandrel 188 comprises radial shoulder 189, which is slidably within enlarged bore wall 221 of mandrel body 220, a seal therebetween being made by O-rings 191. To avoid a vacuum lock which would prevent reciprocation of J-slot mandrel 188 with respect to mandrel body 220, radial passages 223 in mandrel body 220 communicate with an annular passage 255 in spacer body 254, which annular passage in turn leads to radial passages 257 in spacer body 254, which communicate with the exterior of the tool.

A plurality of drag blocks 262 are outwardly biased against liner 34 by drag block springs 264 locked in axial recesses 266 in drag block body 256, being maintained in axial recesses 266 by drag block keepers 268, secured by bolts 270.

The remainder of tool string 60, generally designated by numeral 272 and having bore 274 therethrough, extends below anchor positioner 130 in liner 34.

OPERATION OF THE PREFERRED EMBODIMENT

Referring to FIGS. 1A, 1B, 2A, 2B, 2C, 3 and 6, the operation of the preferred embodiment of the present invention will be described hereafter in detail.

Figure 1B:
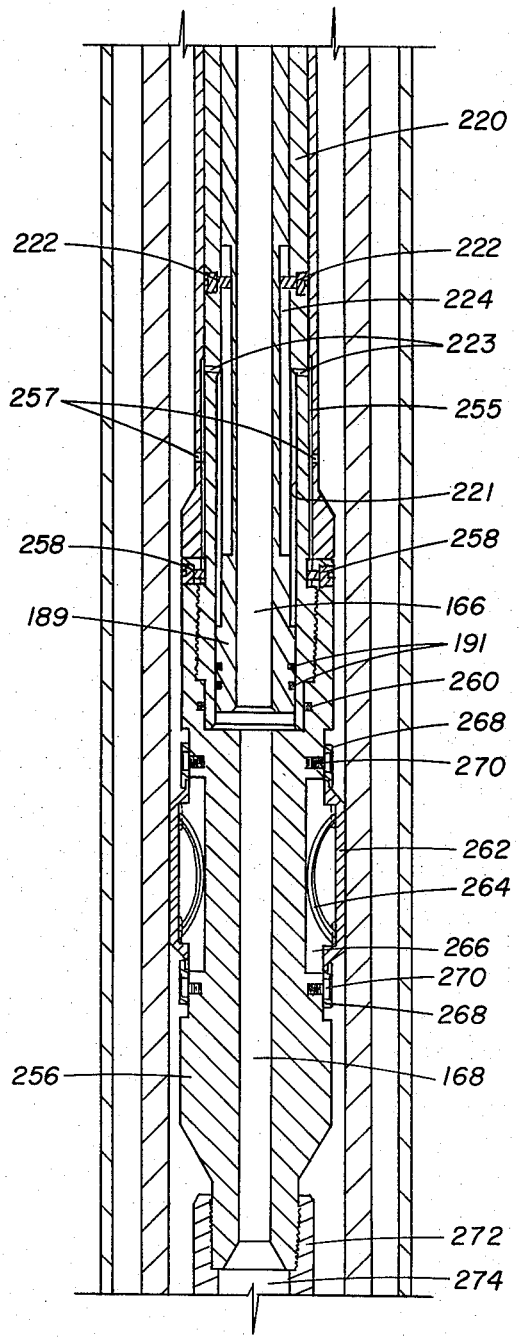
Figure 2A:
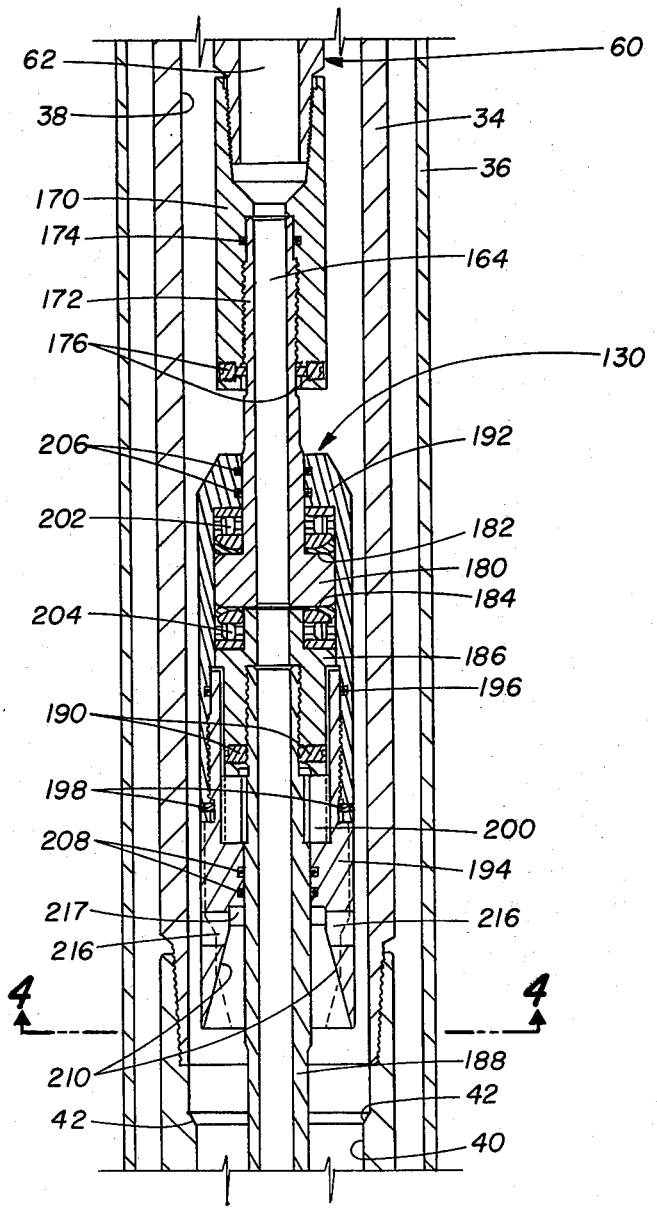
FIGS. 2A, 2B and 2C provide a vertical cross-sectional elevation of the anchor positioner of the present invention in its first, unlocked, release mode, engaging the anchor tool.
Figure 2B:
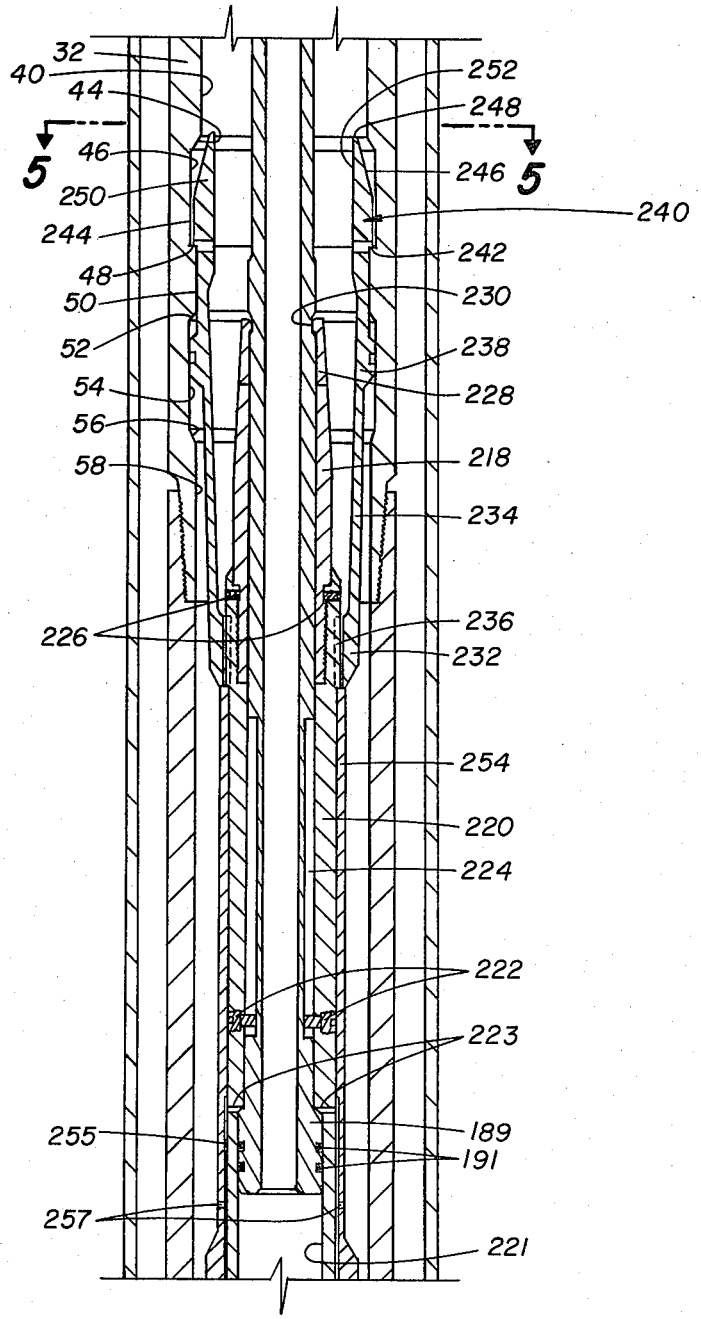
Figure 2C:
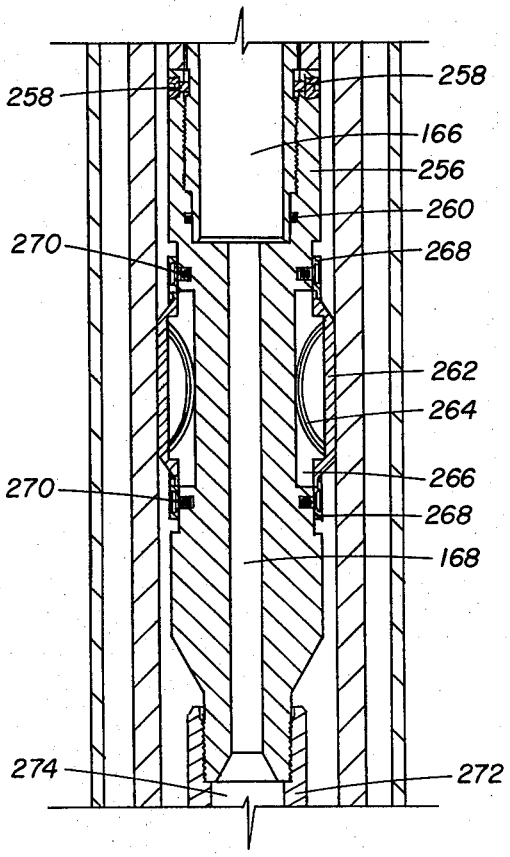
Figure 3:
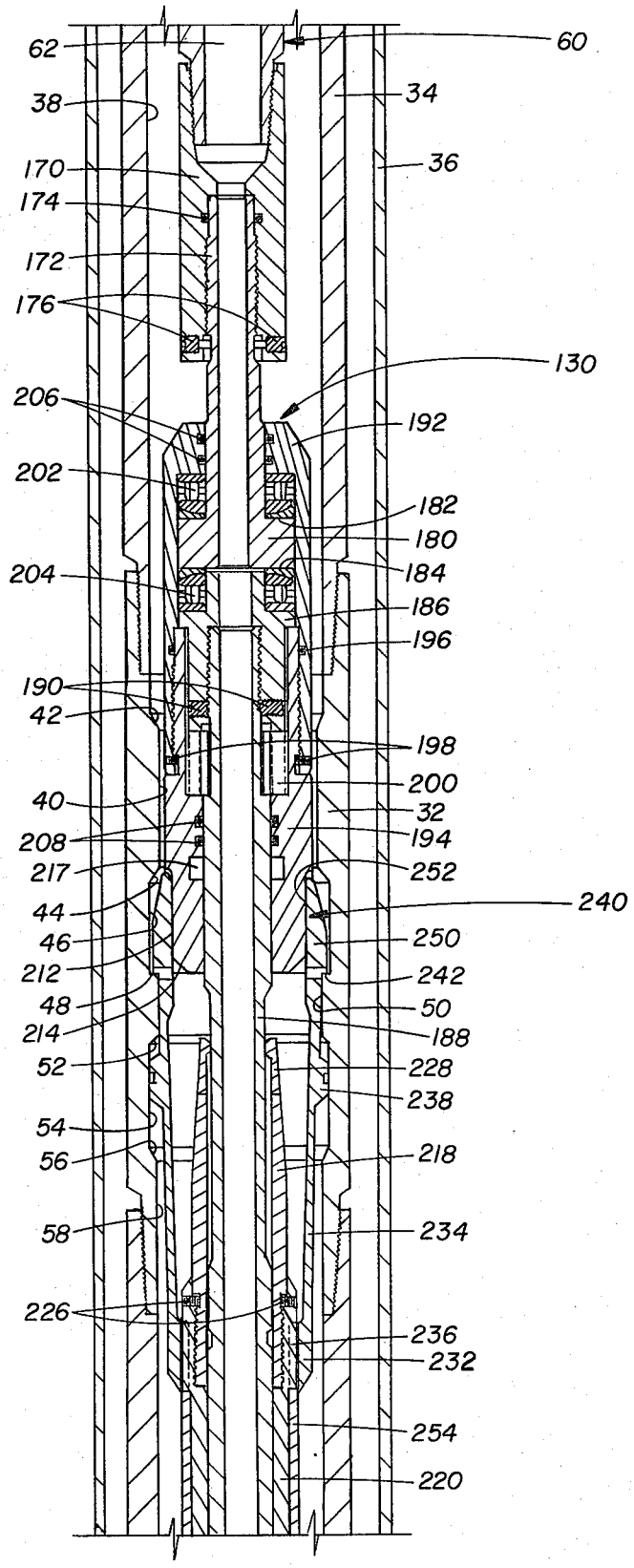
FIG. 3 provides a vertical cross-sectional elevation of the anchor positioner of the present invention in its second, locked release mode, engaging the anchor tool.
Figure 4:
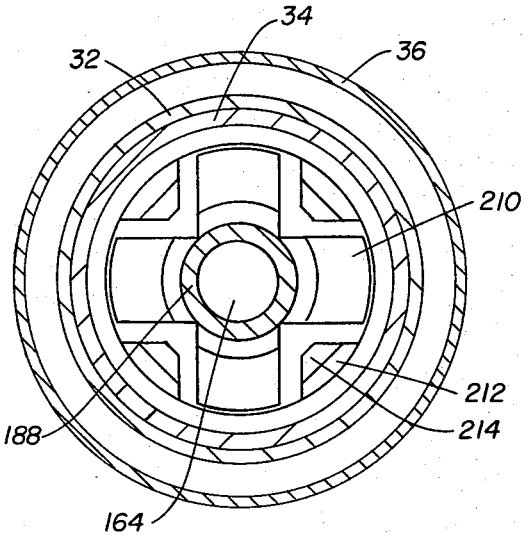
FIG. 4 is a sectional view taken across line 4—4 of FIG. 2A.
Figure 5:
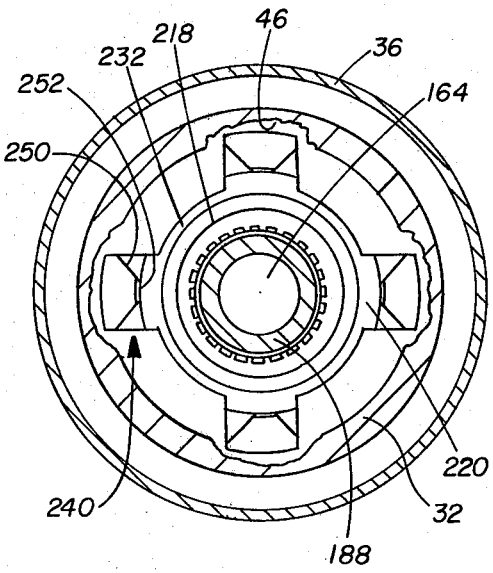
FIG. 5 is a sectional view taken across line 5—5 of FIG. 2B.
Figure 6:
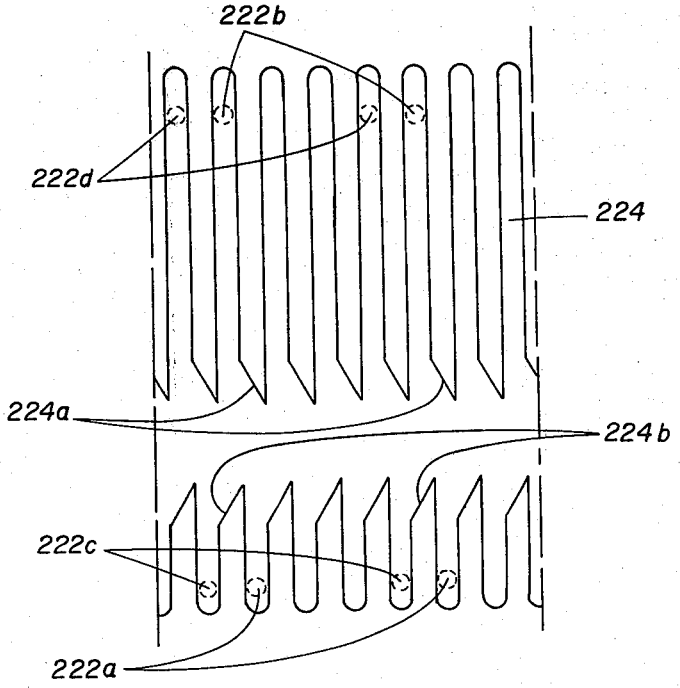
FIG. 6 is a development of the continuous J-slot employed to rotate the indexing head assembly of the present invention from its locked retract mode to its locked release mode.

Anchor positioner 130 has three positions, preferably referred to as "modes" of operation. FIGS. 1A and 1B illustrate anchor positioner 130 in its locked retract mode, wherein outwardly biased spring arms 234 are compressed by indexing head 194. FIGS. 2A, 2B, and 2C illustrate the unlocked release mode of the tool, wherein spring arms 234 have been released by indexing head 194, and have moved radially outward due to their inherent bias. FIG. 3 illustrates the locked release mode of the tool, wherein spring arms 234 are maintained in a released position by indexing head 194. Anchor positioner 130 is changed from one mode to another by reciprocation of tool string 60, which effects the axial sliding and rotation of the indexing head assembly, and particularly indexing head 194, through the travel of J-slot mandrel 188 within mandrel body 220. The sliding engagement of continuous J-slot 224 (see FIG. 6) by J-slot pins 222 provides a rotational force to turn the indexing head assembly. Rotation of the indexing head with respect to tool string 60 is permitted by the nonengagement of upper mandrel 172 with J-slot mandrel 188, and facilitated by the use of roller thrust bearings 202 and 204, the former permitting rotation of indexing head 194 during upward movement of tool string 60, and the latter permitting rotation during downward movement of tool string 60.

As anchor positioner 130 is lowered into liner 34 by tool string 60, it is in its unlocked release mode as shown in FIGS. 2A, 2B and 2C. Spring arms 234 are not engaged by indexing head 194, and are maintained out of engagement by the interaction of collet fingers 228 and annular recess 230 on the exterior of J-slot mandrel 188. J-slot pins 222 of mandrel body 220 are in positions **222*a* in continuous J-slot 224, as shown in the J-slot development of FIG. 6. When the anchor positioner 130 is adjacent to the desired anchor to be engaged, such as anchor 32, movement of tool string 60 is stopped by engagement of annular shoulder 48 on anchor 32 with shoulders 242 at the bottom of protrusions 240 at the ends of spring arms 234**.

After spring arms 234 have engaged anchor 32, a predetermined weight is set down on tool string 60, 4000 pounds by way of illustration, and not limitation which weight causes collet fingers 228 to move out of annular recess 230 on the exterior of J-slot mandrel 188, thus telescoping the anchor positioner and bringing indexing head 194 toward spring arms 234. When anchor positioner 130 is in the unlocked release mode of FIG. 2, spring arms 234 are not radially aligned with either inclined surfaces 210 or axial grooves 212 on indexing head 194, but are rather aligned therebetween. As J-slot mandrel 188 moves downward in response to the application of weight to tool string 60, inclined edges **224*a* of continuous J-slot 224 direct J-slot pins 222** to positions 222*b*, which results in a partial rotation of indexing head 194 to a position where axial grooves 212 are aligned with spring arms 234. As this partial rotation takes place early in the axial movement of J-slot mandrel 188, it is completed by the time indexing head 194 and spring arms 234 make contact. This rotation of indexing head 194 is facilitated by lower roller thrust bearing 204, which is acted upon rotationally by lower annular surface 184 of thrust shoulder 180, J-slot mandrel 188 not being fixed to upper mandrel 172. Rotation of the lower portion of anchor positioner 130 is resisted by the frictional forces of drag blocks 262 on the inside of liner 34. Axial movement of J-slot mandrel 188 is facilitated by passages 223, 225 and 257 which communicate to the exterior of the tool, permitting fluid flow between annular chamber 289 (see FIG. 1B) J-slot 224 and the well bore, preventing pressure buildup or a vacuum lock between J-slot mandrel 188 and mandrel body 220.

It should be noted that, as a practical matter, the operator is able to ascertain if the indexing head 194 will rotate to align the axial grooves 212 or inclined surface 210 with spring arms 234 by the radial position of the indexing head at the surface when anchor positioner 130 is inserted in the well bore. Of course, it is normally desirable to have anchor positioner 130 ready to rotate to engagement of axial grooves 212 and spring arms 234 with only a downward movement of tool string 60. However, if the position of indexing head 194 is not initially noted, or if tool string 60 must be reciprocated prior to contacting the desired first anchor (for example, if the desired first anchor is not uppermost in the well bore), an upward and downward movement of tool string 60 will change anchor positioner 130 between the locked retract mode of FIG. 1 and the locked release mode of FIG. 3, as desired. For purposes of discussion, it is assumed that the first downward reciprocation of tool string 60 will result in anchor positioner 130 being placed in the locked release mode of FIG. 3.

When spring arms 234 are aligned with axial grooves 212, protrusions 240 engage indexing head 194, alignment with grooves 212 being further enhanced by leading edges 214 which gradually move any unexpanded spring arms radially outward. Such a condition of one or more unexpanded, though released, spring arms is likely to occur in a deviated hole, as mentioned previously. As it is not uncommon to have a well bore deviated as much as 70° from the vertical, the weight of the tool string can significantly compress even the strongest spring arms. Radial misalignment of spring arm 234 with an axial groove 212, which may occur during travel of tool string 60 in the well bore due to bending when the tool is in its unlocked release mode, is compensated for by the outwardly inclined lateral surfaces 250 of protrusions 240, which tend to align spring arms 234 with axial grooves 212 as the indexing head 194 moves downward. Anchor positioner 130 is maintained in the locked release mode shown in FIG. 3 by the weight of tool string 60 and the engagement of shoulders 242 on protrusions 240 of spring arms 234 with shoulder 48 of anchor 32. At this time the operator can proceed with a downhole procedure such as gravel packing or cementing, being assured that tool string 60 will be maintained at the proper location throughout the procedure.

To disengage anchor positioner 130 from anchor 32, tool string 60 is reciprocated upwardly, which results in a relative downward movement of J-slot pins 222 in continuous J-slot 224 to position 222*c*, again partially rotating indexing head 194. J-slot pins 222 are guided to position 222*c* by inclined J-slot edges 224*b*. Rotation during uwpard reciprocation is facilitated by the rotational action of upper annular surface 182 of thrust shoulder 180 of upper mandrel 172 upon roller thrust bearing 202. Upward reciprocation has resulted in the release of spring arms 234 by indexing head 194. Subsequent downward reciprocation of tool string 60 results in another partial rotation of indexing head 194, and compression of protrusions 240 on spring arms 234 by inclined surfaces 210 on indexing head 194, the partial rotation again taking place early in the axial travel of J-slot mandrel 188 due to the design of continuous J-slot 224. At the end of the downward movement, pins 222 will be locked in position 222*d*, having been guided there by the inclined edges of continuous J-slot 224. It should be noted that the tips 248 of spring arms 234 are disposed on a radius less than that of the outer extremities of inclined surfaces 210, so that the inclined surfaces 210 will always be in a position to compress the spring arms.

Compression of spring arms 234 results in the locked retract mode of anchor positioner 130 shown in FIGS. 1A–1C, whereby anchor positioner 130 may be lowered through anchor 32 to a lower anchor without fear of re-engagement of anchor 32 by spring arms 234. When anchor positioner 130 is located adjacent another anchor, upward reciprocation of tool string 60 will result in extension of anchor positioner to the unlocked release mode shown in FIG. 2, the tool being maintained in extended position by collet fingers 228 in annular recess 230. Subsequent downward movement will result in the released spring arms 234 engaging the anchor, and the setting down of weight after engagement will result in another telescoping of the anchor positioner 130, a partial rotation of indexing head 194, and the insertion of protrusions 240 in axial grooves 212, which will lock anchor positioner 130 into the anchor, again as shown in FIG. 3.

It should be noted that, as anchor positioner 130 is removed from the well bore on tool string 60, that indexing head 194 is pulled away from spring arms 234, resulting in the unlocked release mode of the tool shown in FIGS. 2A, 2B and 2C. In this instance, spring arms 234 will not hang up in the liner or anchors due to the presence of intermediate shoulders 238, which engage the inner surface of the liner and anchors, compressing spring arms 234 inwardly. This compressing action also takes place when anchor positioner 130 moves downward in the well bore, should anchor positioner 130 be in a released, unlocked mode. In addition, inclined faces 246 on the outside of protrusions 240 tend to force spring arms 234 inwardly when contacting any part of an anchor or liner.

From the foregoing detailed description of the preferred embodiment of the invention and its operation, it is apparent that the present invention comprises a new and advantageous apparatus and method for locating and anchoring a tool string at various levels in the well bore. Of course, the method and apparatus may be employed whenever it is desired to locate and anchor a string of pipe in a well bore having a casing or liner, and is not restricted to operations such as gravel packing or cementing.

Modifications to the above disclosed apparatus and method will render themselves obvious to one of ordinary skill in the art. For example, the number of drag blocks, spring arms and associated inclined surfaces and axial grooves may be changed. In the latter instance, the number of channels in the continuous J-slot would be modified. The drag blocks may be biased by coil springs or elastomers rather than leaf springs. the J-slot might be incorporated in the body mandrel, with J-slot pins protruding from the J-slot mandrel in lieu of the disclosed configuration. Furthermore, in lieu of spring arms, springbiased dogs having tapered edges facing the indexing head and an undercut to interlock with the axial grooves on the indexing head could be employed. Accordingly, modifications such as these and others are contemplated without departing from the spirit and scope of the claimed invention.

I claim:

1. Apparatus for positioning and anchoring a tool string in at least one location in a well bore having conduit means disposed therein, comprising:

anchor means fixed to said conduit means at said at least one location in said well bore said anchor means having radially inward extending shoulder means thereon; and anchor positioner means attached to said tool string and having locking and engagement means thereon, said engagement means comprising a plurality of spring arms having shoulder means thereon extending radially outward from said plurality of spring arms;

said engagement means having a locked release mode and a retract mode, the outermost edge of said spring arm shoulder means being located on a radius of greater extent than that defined by the innermost edge of said anchor shoulder means when said engagement means is in said locked release mode, and being located on a radius of lesser extent than that defined by said anchor shoulder means innermost edge when said engagement means is in said retract mode.

2. The apparatus of claim 1 wherein said at least one location is a plurality of locations, and said at least one anchor means being a plurality of anchor means fixed to said conduit at said plurality of locations.

3. The apparatus of claim 2 wherein said plurality of anchor means are substantially identical.

4. The apparatus of claim 1 wherein said locking means is adapted to selectively lock said engagement means to said anchor means in response to movement of said tool string.

5. The apparatus of claim 4 wherein said movement is axial movement.

6. The apparatus of claim 1, wherein said locking means further comprises:

indexing head means to effect said locked release mode and said retract mode of said engagement means.

7. The apparatus of claim 6, wherein:

said anchor shoulder means engages said shoulder means on said plurality of spring arms in said locked release mode.

8. Apparatus for positioning and anchoring a tool string in at least one location in a well bore having conduit means disposed therein, comprising:

anchor means fixed to said conduit means at said at least one location in said well bore; and anchor positioner means attached to said tool string and having engagement means and locking means thereon, said engagement means including a plurality of spring arms having a retract and a locked release mode, said locking means including indexing head means to effect said retract mode and said locked release mode, said indexing head having a plurality of inclined faces thereon radially spaced with a plurality of axial grooves, said indexing head being axially and rotationally slidably mounted on said anchor positioner, said indexing head means effecting said retract and locked release modes of said plurality of spring arms by axial movement toward said plurality of spring arms, said retract mode being effected by contact of said spring arms by said inclined faces, and said locked release mode being effected by contact of said spring arms by said axial grooves.

9. The apparatus of claim 8, wherein said at least one location is a plurality of locations, and said at least one anchor means is a plurality of substantially identical anchor means fixed to said conduit at said plurality of locations.

10. The apparatus of claim 8 wherein said anchor positioner further comprises slot means and pin means adapted to rotate said indexing head means in response to axial movement of said tool string.

11. The apparatus of claim 10 wherein said slot means and said pin means rotate said indexing head means so as to align said spring arms with said inclined faces in one position, and with said axial grooves in another position.

12. The apparatus of claim 11 wherein said indexing head is realigned in response to an upward and downward axial movement of said tool string.

13. The apparatus of claim 10 wherein said slot means comprises a continuous J-slot, and said pin means comprises at least one J-slot pin.

14. The apparatus of claim 13 wherein said continuous slot is associated with said indexing head means, and said J-slot pin is fixed to said anchor positioner, said rotation of said indexing head being effected by sliding engagement of the edge of said continuous slot with said J-slot pin.

15. An anchor positioner suitable for attachment to a tool string disposed in a well bore, comprising:

spring arm means; and indexing head means having inclined face means radially spaced with axial groove means, said spring arm means being positively retracted by contact with said inclined face means, and positively extended by contact with said axial groove means in response to reciprocation of said tool string.

16. The anchor positioner of claim 15, wherein said indexing head means is axially and radially movable with respect to said spring arms.

17. The anchor positioner of claim 16, wherein said indexing head means moves axially and radially in changing said spring arm means between said positively retracted and said positively extended positions.

18. The anchor positioner of claim 17, wherein said indexing head means moves axially and radially in response to the slidable engagement of pin means and slot means, one of said pin means and slot means being fixed to said spring arm means, and the other of said pin means and slot means being fixed to said indexing head means.

19. The anchor positioner of claim 18, wherein said slidable engagement of said pin means and said slot means is effected by axial movement of said tool string.

20. Anchor positioner adapted to be disposed in a well bore to selectively engage anchors disposed in a conduit in said well bore, said anchors comprising radially inward extending annular shoulders, said anchor positioner comprising:

mandrel means having indexing head means attached thereto and a continuous slot on the surface thereof;

mandrel body means having spring arms thereon with radially outward extending shoulders and a longitudinal bore therein in which said mandrel means is axially and radially slidable, said mandrel body means having pin means fixed thereto, said pin means extending into said continuous slot in said mandrel means, whereby reciprocal motion between said mandrel means and said mandrel body means results in axial and radial movement between said indexing head means and said spring arm means, and positive extension and retraction of said spring arms by said indexing head means for engagement and disengagement with said anchors;

attachment means to attach said anchor positioner to a tool string; and thrust roller means adapted to facilitate rotation between said indexing head means and said tool string.

21. The anchor positioner of claim 20 wherein said mandrel body means possesses drag block means on the exterior thereof.

22. The anchor positioner of claim 20 further comprising radially spaced inclined faces and axial grooves on said indexing head means, said radial and axial movement of said indexing head resulting in alignment and engagement of said spring arms with either said inclined faces or said axial grooves on said indexing head, engagement of said spring arms with said axial grooves resulting in extension of said spring arms and with said inclined faces resulting in retraction of said spring arms.

* * * * *